US007260972B2

(12) United States Patent
Krajewski

(10) Patent No.: US 7,260,972 B2
(45) Date of Patent: Aug. 28, 2007

(54) METHOD FOR PRODUCTION OF STAMPED SHEET METAL PANELS

(75) Inventor: Paul E. Krajewski, Sterling Heights, MI (US)

(73) Assignee: General Motors Corporation, Detroit, MI (US)

( * ) Notice: Subject to any disclaimer, the term of this patent is extended or adjusted under 35 U.S.C. 154(b) by 229 days.

(21) Appl. No.: 10/797,861

(22) Filed: Mar. 10, 2004

(65) Prior Publication Data

US 2005/0199032 A1 Sep. 15, 2005

(51) Int. Cl.
*B21D 31/00* (2006.01)
*B21D 37/16* (2006.01)

(52) U.S. Cl. ..... 72/379.2; 72/342.5

(58) Field of Classification Search ..... 72/342.5, 72/342.94, 342.1
See application file for complete search history.

(56) References Cited

U.S. PATENT DOCUMENTS 4,324,596 A * 4/1982 Wuebker ..... 148/696
5,776,270 A * 7/1998 Biondich ..... 148/696
6,003,359 A * 12/1999 Futamura et al. ..... 72/404
6,033,499 A * 3/2000 Mitra ..... 148/688
6,038,911 A * 3/2000 Krajewski et al. ..... 72/379.2
6,224,992 B1 * 5/2001 Delbeke et al. ..... 428/654
6,344,096 B1 * 2/2002 Baumann et al. ..... 148/551
2004/0256079 A1 * 12/2004 Akkurt et al. ..... 164/480
2006/0016523 A1 * 1/2006 Dif et al. ..... 148/551

* cited by examiner

*Primary Examiner*—Derris H. Banks
*Assistant Examiner*—Teresa M. Bonk

(57) ABSTRACT

Sheet metal parts having significantly strained portions, such as aluminum alloy body panels, can be formed by a sequence of steps comprising preform shape stamping, preform annealing and final shape stamping. The shape of the desired part is analyzed to identify portions of the geometry that cannot be formed in a single stamping step without exceeding the straining limit of the metal. A preform shape is determined in which a substantial amount of strain is stamped without tearing and the preform is annealed to re-soften the strained areas and a final stamping step completes development of the final part shape.

14 Claims, 2 Drawing Sheets

METHOD FOR PRODUCTION OF STAMPED SHEET METAL PANELS

TECHNICAL FIELD

This invention pertains to high deformation stamping of sheets of work hardenable aluminum alloys. More specifically this invention pertains to a process for the rapid production of one piece stamped aluminum sheet panels that cannot be formed in a single stamping operation without damaging the part.

BACKGROUND OF THE INVENTION

Automotive body panels and sheet metal products have been made of suitable steel alloys by stamping processes at ambient temperatures. The edges of a steel sheet blank are gripped by a binder mechanism and a punch pushes and draws the metal against a generally concave forming surface. Often a steel alloy is available that is suitably formable and the metal is stretched into a complex shape such as a body panel without tearing, wrinkling or otherwise marring the sheet. A progressive sequence of stamping and, for example, piercing and trimming operations may be successively performed on a single steel sheet to make a panel with each step being completed in a matter of seconds.

Aluminum sheet alloys would be substituted for steel in many applications to save weight. For example, some Aluminum Association alloys of the 1×××, 3××× and 5××× series have been used in stamping operations. But such aluminum stamping alloys are not as ductile and formable as steel alloys and the aluminum often tears if it is stamped to the same shape. The aluminum alloy work-hardens at stamping strain rates and some portion of the sheet yields and tears. This property of aluminum alloys has limited the product shapes to which they can be formed by high production rate stamping. Complex panel shapes often have to be made in multiple pieces and welded together. This usually results in higher manufacturing cost and may complicate dimensional control of the composite product.

It is an object of this invention to provide a method for using work-hardenable aluminum sheet alloys in relatively high production rate stamping operations to form one-piece products whose shape includes areas of deformation that exceed the strain limits of the starting sheet material.

SUMMARY OF THE INVENTION

This invention is particularly applicable to the stamping of a work-hardenable aluminum alloy sheet where some portion of the sheet will be deformed beyond its strain limit in reaching the shape of the desired product. An aluminum sheet metal alloy is selected for the stamping of a particular part, the alloy having known tensile stress-strain properties in its cold rolled and tempered condition preparatory for stamping. A sheet metal blank of suitable area profile and thickness is specified. The capability of the blank to be stamped into the desired product shape using punch/concave cavity type tooling is assessed. Such assessment maybe conducted experimentally and/or by a suitable computational model using, for example, a finite element analysis method (FEM). If it is found that the proposed part cannot be made in a stamping operation without tearing or wrinkling the blank material, the following preform stamping/rapid anneal/final stamping practice is used.

The strategy of the practice of this invention is to stamp the sheet metal blank into a preform structure that embodies a substantial portion of the deformation required to acquire the final shape of the part without marring the aluminum sheet and without substantial thinning of the sheet. The strain-hardened preform is then rapidly heated to anneal and re-soften the sheet for a final stamping operation to reach the final product shape, except for supplemental trimming, piercing, or flanging steps, or the like. Often only a highly strained region of the sheet requires annealing and this is considered in selecting or specifying an annealing practice and apparatus. Preferably the annealing step is accomplished within a period of seconds (e.g., ten seconds or so) and the preform is cooled for the final shape stamping operation.

The preform stamping step, the rapid anneal step and the final shape stamping step are coordinated to quickly achieve the product shape desired at the end of the second stamping step. Thus, the preform step is severe enough so that the final shape can be attained after the annealing step. The temperature and duration of the anneal step are preferably determined for each product to suitably soften the preform so as to obtain the sheet metal shape desired after the second stamping operation. It may not be necessary or desirable to anneal the entire preform sheet. Deformed area(s) can be identified for annealing which can reduce the size of the heat treatment apparatus and reduce the time required for the annealing step. A goal of the annealing step is to restore the deformed regions of the preformed sheet close to their original temper condition, typically temper designation O, without causing excessive grain growth and loss of original specified physical properties in the sheet material. The annealing step is performed so that the preformed sheet can be stamped to its final shape in a single final stamping operation.

A typical sheet metal stamping operation is completed within a period of about ten seconds. A sheet metal blank is placed in an open press between complementary stamping dies. The press is closed so that the tools shape the metal sheet and the press is opened and the stamped part removed. In the practice of this invention, the first stamping step, the annealing step and the final stamping step are each completed in about the same time period, for example ten to fifteen seconds, so that a suitable production rate of stamped parts is attained. The annealing step is conducted so that it doesn't unduly slow the overall two-stage stamping operation. Preferably, an annealing step does not take longer than twice the duration of the slower of the preform stamping step or final shape form stamping step.

If a substantial portion of the stamped preform sheet is annealed, a cooling step may be desirable before the final stamping operation. Cooling of annealed regions of the sheet occurs by conduction to unheated portions and by convection and radiation from the sheet to the atmosphere. Such cooling rates can be increased by forced air circulation over the annealed surfaces or water spray, or the like. Any cooling and/or lubrication of the preformed sheet is to be finished within a time period like those required for the stamping steps so that overall continuous line speed is not unduly slowed.

Sometimes it is desired to make aluminum body panels on tooling made for stamping more formable steel blanks into the panel shape. This situation can be used to illustrate one mode of practicing the invention. In stamping the steel sheet the edges of the blank are restrained and a punch tool is moved to push the sheet against a concave die surface to obtain the part shape. The punch is then withdrawn and the part removed for trimming, etc. The stroke of the punch in pressing the sheet into conformity with the female tool surface is a known distance. Often, if an aluminum alloy blank is substituted for the steel blank, the less formable aluminum alloy material tears in the stamping operation. In the practice of this invention for aluminum panels, the stroke of the punch is limited and tested at different distances from its bottom position in stamping steel panels. A suitable partial punch stroke is determined experimentally for preforming the aluminum sheet. The preform sheet is removed from the tools, annealed, cooled and returned to the stamping press. The punch is now moved through its full stroke to complete deformation of the aluminum preform to the desired product shape.

In a more general embodiment of the invention, the deformation of the aluminum sheet alloy to a desired product shape is simulated by a numerical model to determine a suitable preform shape for annealing prior to a final stamping step. Trial preform tooling is made and the preform shape obtained, hopefully without marring of the sheet material. Selected portions (or all) of the sheet is annealed at trial temperatures to suitably soften deformed regions for final shaping on finish tools.

The invention was developed for the stamping of aluminum alloys, especially aluminum alloys of the AA 1×××, 3×××, and 5××× series. But it is applicable in general to sheet metal stamping operations in general. The invention is applicable when a desired part cannot be stamped in a single operation from a stamping sheet metal alloy of choice without exceeding the straining limit of the material in some portion of the geometry of the part.

Other objects and advantages of this invention will become more apparent from a detailed description of preferred embodiments which follows.

DESCRIPTION OF A PREFERRED EMBODIMENT

Automotive vehicle body panels such as hoods have been stamped using commercial aluminum alloy sheet materials such as Aluminum Association alloys (AA) 5182 and 5754. AA 5182 has a nominal composition, by weight, of 4.50% magnesium, 0.35% manganese 0.20% silicon, 0.15% copper, 0.10% chromium, 0.25% zinc and the balance substantially aluminum. AA5754 has a nominal composition, by weight, of 2.7% magnesium, 0.80% manganese, 0.12% chromium and the balance substantially aluminum. These materials are cast, hot rolled and cold rolled to a desired sheet thickness, typically 1 to 2.5 mm, and annealed or tempered to recrystallize the work strained microstructure so that the coiled sheet material is in the most formable state (O temper condition) obtainable from the alloy composition.

Generally, aluminum sheet alloys are not as formable as available low carbon steel sheet alloys. Designers of automobiles now seek body panel surfaces and configurations with relatively deep pockets and other sharp bends. Given a specific panel design the engineers of the stamping process favor making the part in a single stamping operation to save tooling costs and manufacturing time. A sheet metal blank of suitable thickness and two dimensional shape is developed together with complementary two-part (punch/concave cavity) tooling for obtaining part shape from the flat blank. Trimming and piercing of the shaped sheet metal may follow.

Aluminum alloys have been successfully stamped into vehicle hoods because hoods are often rather simple closure panels to make. However, vehicle door and tailgate inner panels are parts of more complex shape and they have been difficult to stamp as a single piece. Often, the aluminum alloy cannot be shaped into the configuration of the desired part, even with heavy lubrication, without tearing, wrinkling or otherwise marring the sheet material. In the usual case of tearing, the sheet is damaged because the strain limit of the material is exceeded at one or more locations of the geometry of the sheet as it is being stretched between the stamping tools.

Figure 1A:
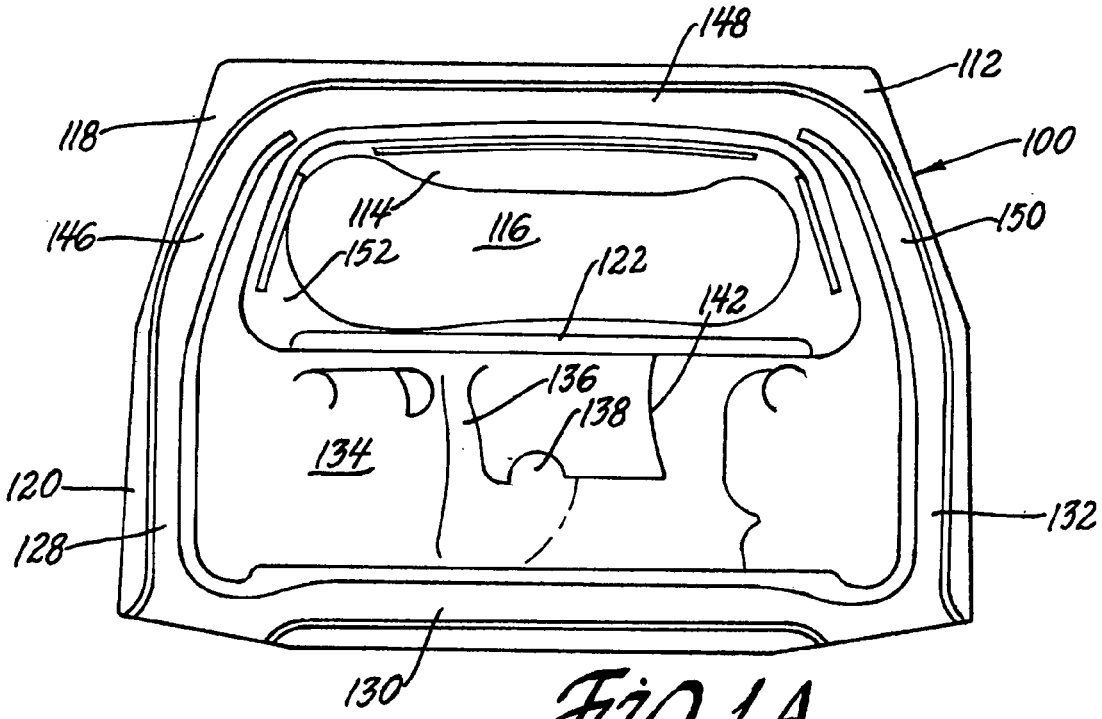
FIG. 1A is a schematic plan view of a preform stamping of an aluminum alloy inner panel for a tailgate of an automobile vehicle.
Figure 1B:
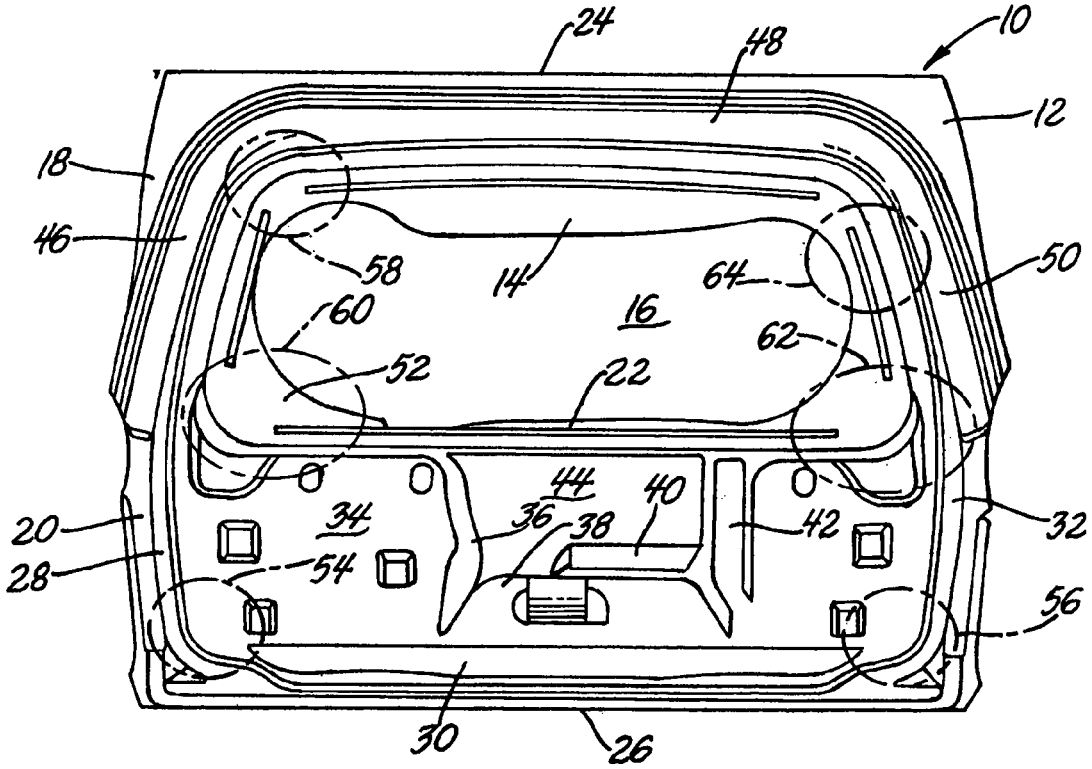
FIG. 1B is a schematic plan view of a final shape stamping of a one-piece aluminum alloy inner panel for a liftgate of an automotive vehicle.

FIG. 1B is a schematic plan view of a stamping 10 for an inner tailgate panel for a sport utility vehicle. Stamping 10 was made from a developed blank of AA5082-O sheet metal. The blank was about four feet across, three and one-half feet wide and about one millimeter thick. It was trapezoidal in plan view. Material in the location of the intended tailgate window hole was removed from the blank.

As illustrated in FIG. 1B, stamping 10 has not been trimmed for assembly with an outer panel. An inner panel like that illustrated in FIG. 1B will be hemmed or otherwise attached to an outer panel in the assembly of the tailgate. The face of the stamping shown in FIG. 1B will lie adjacent the inner face of the outer panel and the two panels when assembled provide a compartment between them for window and tailgate latching mechanisms, window wiper drives, wiring for lights, and other components carried by the tailgate.

Illustrated is the aluminum alloy sheet stamping 10 before trimming of edge material 12 and trim material 14 at the window opening 16. Stamping 10 comprises an upper portion 18 for receiving a window glass that typically contains an electrical resistance heating element for defrosting and a lower portion 20 for defining one side of a compartment for the mechanisms described above. Upper portion 18 and lower portion 20 are bent at beltline 22. Upper portion 18 and lower portion 20 extend below the plane of the drawing figure and belt line 22 above the plane. Thus, the belt line 22 in the completed stamping 10 may lie 4 to 5 inches above the plane of the edges 24, 26 of the upper portion 18 and lower portion 20. Lower portion 20 of stamping 10 has a box section defined by side walls 28, 30 and 32 and bottom 34. The box section defined by walls 28, 30, and 32 is about four inches deep and provides one side of the above described compartment for hardware and mechanisms to be contained in a tailgate. There is another prominent box section in lower portion 20 of stamping 10 defined by walls 36, 38, 40, 42 and floor 44. This box section provides a complementary depression for a license plate pocket formed in the outer panel of the tailgate, not shown.

Upper portion 18 of stamping 10 also has a box section defined by walls 46, 48, 50 and floor 52. This box portion of stamping 10 provides metal for enclosing a glass window in the assembled tailgate. There are other shaped features of stamping 10 illustrated in FIG. 1B which are used in the assembly of a tailgate and components retained between the inner and outer panels, but these other features are not as critical in the making of stamping 10 as those which have been described.

Dashed line circles 54 and 56 indicate sharp bend corner portions between stamped walls 28, 30 and bottom 34, and walls 30, 32 and bottom 34, respectively in which splits and tears occur in the aluminum alloy metal of stamping 10 if it is formed in a single step. The window area of the upper portion 18 of stamping 10 also contains a stamped box section, as described, and tears occur at the circled areas 58, 60, 62 and 64 near corners of the window opening portion 16 of stamping 10.

Thus, the six dashed line circled areas 54, 56, 58, 60, 62, and 64 indicate portions of the finished shape of the illustrated tailgate inner panel stamping 10 that are difficult or impossible to form in a single stamping operation without splits or tears when panels are to be repetitively stamped at a commercially acceptable strain rates and stamping rates. The tailgate panel illustrated by stamping 10 has significantly strained portions in many of the stamping and is hard to form in a single step from a AA5082 sheet at ambient temperatures.

Suitable two-piece complementary punch/concave cavity tooling was available for making the one piece stamping from low carbon sheet material one millimeter thick. The stamping illustrated in FIG. 1B is readily formable from steel blanks on a continuous production basis. But it is desired to make the large inner panel structure from a lighter aluminum alloy. An attempt was made to make the stamping from a blank of AA5754-O temper, using heavy lubrication and a slowed stamping stroke, but tears occurred in the product at circled regions 54-64. A second attempt was made using a blank of AA 5182-O with the same result. This led to the formulation of an embodiment of this invention.

Several blanks were prepared with a trapezoidal perimeter and a cut-out window opening portion 16 as can be perceived from the shape of the finished stamping in FIG. 1B. The next step was to partially form the panel by cycling the press some distance from the bottom of the stroke ("off-bottom"). The punch was stopped at different distances from its bottom position in which the sheet metal is fully pressed against the die surface. The amount of preforming was varied to determine the deepest part possible without necking or tearing. The preform stamping 100 for the tailgate panel that satisfied this condition is illustrated in FIG. 1A. It was formed by stopping the punch motion 19 millimeters off-bottom. Cycling the press deeper produced splits in the sheet material at the circled locations of FIG. 1B.

Preform stamping 100 contains the beginnings of many of the shape features of final shape stamping 10 in FIG. 1B. Shape features of preform stamping 100 that correspond to shape features of final stamping 10 are indicated by numerals 1×× where the ×× values correspond to features described with respect to stamping 10.

As illustrated in FIG. 1A the shape of preform stamping 100 has progressed such that upper portion 118, lower portion 120 and beltline 122 are perceptible. The bent shape of the final panel has been started in the preform stamping 100. In upper portion 118 of preform 100, walls 146, 148 and 150 and bottom 152 of the window receiving box section have been substantially formed without edge tears in the sheet metal portion 114. In lower portion 120 of preform stamping 100, walls 128, 130, 132 and bottom 34 of the lowed box section have been substantially formed but not to final edge sharpness and wall angle. However, there is no equivalent forming of license plate pocket defined by walls 36, 38, 40 and 42 in the preform stamping 100. Regions 136, 138, 140 show only minimal initial forming of the license pocket. Preform stamping 100 is a result of the punch having traveled only about 75% of its stroke in pushing the sheet material toward the opposing die surface.

Sheet metal preform 100 was removed from the die and placed in a furnace sized to hold a single preformed blank. The standard heating and annealing cycle for the cold worked AA5182 preform blank was 10 minutes in the oven which was maintained at 350° C. The ten minute heating and annealing period was known to completely remove the effect of the preform stamping cold work from the sheet metal and restore its original O temper condition for the final shape stamping step.

The annealed panel was removed from the furnace, allowed to cool in ambient air to room temperature, and then placed back in the press. The annealed preform was re-lubricated with boron nitride prior to the redraw operation. The stroke of the punch was completed to its bottom position and the finish shape stamping of FIG. 1B produced without defect.

Figure 2:
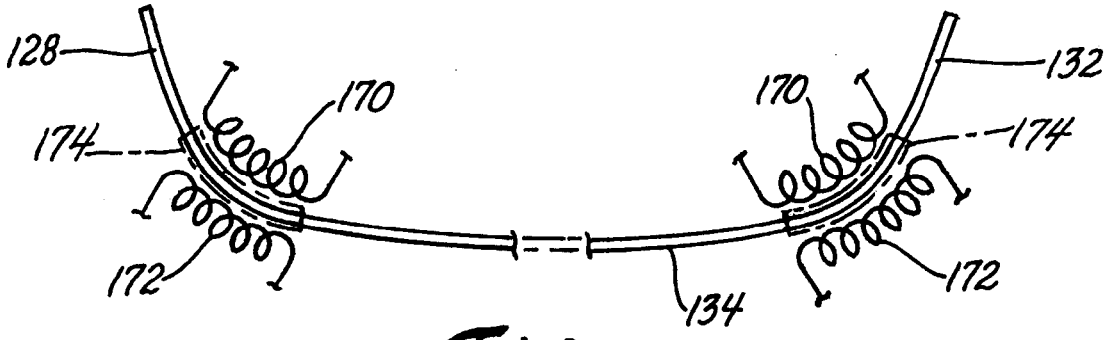
FIG. 2 is a fragmentary cross-sectional view of a lower corner region of the liftgate panel of FIG. 1B showing a stamped preform shape and annealing location.
Figure 3:
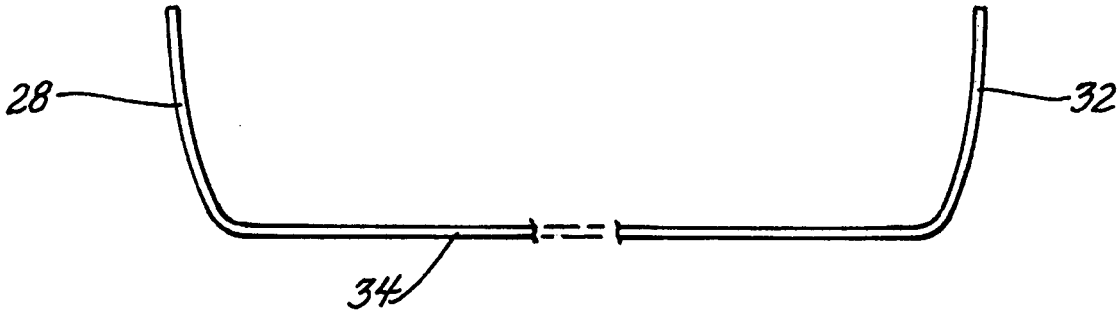
FIG. 3 is a fragmentary final stamped shape of the preform and annealed portion of the liftgate panel section of FIG. 2.

In stamping many article shapes it is neither necessary nor preferred to heat and anneal the entire article following the preform stamping step. Only the region or regions of the sheet metal that experience relatively high strain need be annealed. Furthermore, there are more rapid heating methods than a convection heating furnace. For example, FIG. 3 contains two separated cross sections of the stamped panel 10 of FIG. 1A. On the left side of FIG. 3 is a section of wall 28 and floor 34 in region 54 of the stamping 10, and at the right side of FIG. 3 is a similar section of wall 32 and floor 34 in region 56 of the stamping. These sections illustrate the nearly 90° angle between the walls 32, 34 and floor in these portions of the stamping 10. FIG. 2 is a like section of the preform stamping 100 of FIG. 1A. In preform stamping 100 the curvature between walls 128, 132 and floor 134 is much gentler. The strain at these locations of the preform stamping 100 is close to the strain limit of the AA5182 alloy considering the total effect of the stamping work in deforming the preform stamping 100 to its present shape.

As illustrated schematically in FIG. 2, internal induction heating coils 170 and external heating coils 172 are used to selectively and rapidly anneal high strain regions of preform 100 before the final shape stamping step is performed. Such coils are connected to alternating current electrical power sources and controlled to anneal such selected high strain regions 174 which are indicated in FIG. 2 at 174 in this example. The shape, orientation and positioning of the coils is adapted for the specific annealing job in accordance with known induction heating technology for the sheet metal material. The goal of the annealing heat treatment is to restore the formability of the material to an extent suitable for the second and final stamping step. This annealing is preferably accomplished within about ten seconds and preferably within a time period no longer than about twice the duration of a stamping step preceding or following the anneal step. It is desired that the annealing step does not unduly slow the stamping operations in a continuous sequence of stamping-annealing-stamping steps.

The sheet metal preform 100 is rapidly cooled to about ambient temperature, re-lubricated if necessary with a stamping lubricant of choice, and stamped to final product shape.

An extensive amount of experimental work has demonstrated that sheet metal sections of work hardening aluminum alloys, like AA5082, can be induction heated in a matter of several seconds to temperatures of, e.g., about 350° C. The microstructure of the strained and work hardened sheet is restored to, or close to, the preferred O-temper condition of the blank material shaped in the preform stamping operation. By heating only relatively highly strained portions of preform 100, cooling of the annealed regions is expedited by rapid heat loss to the unheated portions of the preform stamping.

The invention has been described in terms of certain preferred embodiments but the scope of the invention is not intended to be limited to the described embodiments.

The invention claimed is:

1. A method of stamping an article from an aluminum alloy sheet material, said sheet material having a thickness and a straining limit, where the shape of said article cannot be stamped into said sheet in a single stamping operation without exceeding the straining limit of the sheet at a location in said article, said sheet material being strain hardenable and having known stress/strain forming properties and being initially in a softened condition for forming by stamping, said method comprising:

predetermining, from said stress/strain forming properties and the thickness of said sheet, a preform shape that is a deformation precursor of said article shape and includes at least one region in the preform shape that is to be strained up to, but not exceeding, the straining limit of the sheet material and the strain is higher than in adjacent portions of the preform shape, and an annealing practice for re-softening the at least one region of said preform shape, said preform shape and said annealing practice enabling one step stamping of said article shape from said preform shape without exceeding the straining limit of the sheet; and thereafter stamping a blank of said sheet material into said preform shape using a punch and a forming surface tool where the at least one region is strained and formed by stretching the sheet in contact with the punch and forming tool;

annealing at least said strain-hardened region of said preform by said annealing practice; and stamping said annealed preform to the shape of said article using a punch and a forming surface tool, the duration of said annealing step being no greater than twice the duration of either of said stamping steps.

2. A method of stamping an article as recited in claim 1 where said stamping of said preform shape, the annealing of said annealed preform and the stamping of said annealed preform to the shape of said article are performed in a continuous sequence of operations of substantially equal duration.

3. The method of stamping an article as recited in claim 1 in which the period of heating for the annealing of said preform shape is no more than fifteen seconds.

4. The method of stamping an article as recited in claim 1 in which the period of heating for the annealing of said preform shape and a period for cooling of the annealed preform enables the preform stamping/preform annealing/final shape stamping sequence of steps to be performed as a continuous process sequence.

5. The method of stamping an article as recited in claim 1 in which said annealing step restores the temper of the preform stamping to the temper quality of the sheet metal material prior to said preform stamping step.

6. The method of stamping an article as recited in claim 2 in which said annealing step restores the temper of the preform stamping to the temper quality of the sheet metal material prior to said preform stamping step.

7. The method of stamping an article as recited in claim 3 in which said annealing step restores the temper of the preform stamping to the temper quality of the sheet metal material prior to said preform stamping step.

8. The method of stamping an article as recited in claim 4 in which said annealing step restores the temper of the preform stamping to the temper quality of the sheet metal material prior to said preform stamping step.

9. The method of stamping an article as recited in claim 1 in which said sheet metal material is a magnesium containing, aluminum alloy of the AA5××× family.

10. The method of stamping an article as recited in claim 2 in which said sheet metal material is a magnesium containing, aluminum alloy of the AA5××× family.

11. The method of stamping an article as recited in claim 3 in which said sheet metal material is a magnesium containing, aluminum alloy of the AA5××× family.

12. The method of stamping an article as recited in claim 4 in which said sheet metal material is a magnesium containing, aluminum alloy of the AA5××× family.

13. A method of stamping an automotive body panel from an aluminum alloy sheet material, said sheet material having a thickness and a straining limit, where the shape of said body panel cannot be stamped into said sheet in a single stamping operation without exceeding the straining limit of the sheet at a location in said body panel, said sheet material being strain hardenable and having known stress/strain forming properties and being initially in a softened condition for forming by stamping, said method comprising:

predetermining, from said stress/strain forming properties and the thickness of said sheet, a preform shape that is a deformation precursor of said body panel shape and includes at least one region in the preform shape that is to be strained up to, but not exceeding, the straining limit of the sheet material and the strain is higher than in adjacent portions of the preform shape, and an annealing practice for re-softening the at least one region of said preform shape, said preform shape and said annealing practice enabling one step stamping of said body panel shape from said preform shape without exceeding the straining limit of the sheet; and thereafter stamping a blank of said sheet material into said preform shape using a punch and a forming surface tool where the at least one region is strained and formed by stretching the sheet in contact with the punch and forming surface tool;

annealing the at least one region of said preform by said annealing practice;

cooling said annealed preform; and stamping said annealed preform to the shape of said body panel using a punch and a forming surface tool, the duration of each of said stamping steps and of said annealing and cooling steps are managed so that said body panel is formed by said steps in a continuous process sequence.

14. The method of stamping a body panel as recited in claim 13 in which said sheet metal material is a magnesium containing, aluminum alloy of the AA5××× family.

* * * * *